US005937259A

United States Patent [19]

Kopp et al.

[11] Patent Number: 5,937,259

[45] Date of Patent: Aug. 10, 1999

[54] ELECTROGRAPHIC PRINTER WITH COMPENSATION DEVICES

[75] Inventors: Walter Kopp, Taufkirchen; Anton Stürzer, Grafing; Josef Windele, Puchheim; Otto Olbrich, Taufkirchen, all of Germany

[73] Assignee: Oce Printing Systems GmbH, Poing, Germany

[21] Appl. No.: 09/051,786

[22] PCT Filed: Aug. 28, 1996

[86] PCT No.: PCT/DE96/01591

§ 371 Date: Jul. 1, 1998

§ 102(e) Date: Jul. 1, 1998

[87] PCT Pub. No.: WO97/17635

PCT Pub. Date: May 15, 1997

[30] Foreign Application Priority Data

Nov. 3, 1995 [DE] Germany ..... 195 41 061

[51] Int. Cl.[6] ..... G03G 15/00

[52] U.S. Cl. ..... 399/384; 399/316

[58] Field of Search ..... 399/384, 316, 399/317, 388, 397; 271/9.1; 226/38, 39, 195; 347/153, 264

[56] References Cited

U.S. PATENT DOCUMENTS

| | | | |
|---|---|---|---|
| 4,131,358 | 12/1978 | Windele . | |
| 4,213,551 | 7/1980 | Windele | 226/74 |
| 4,297,716 | 10/1981 | Hirayama et al. | 347/139 |
| 4,392,738 | 7/1983 | Fujino et al. | 399/317 |
| 4,699,496 | 10/1987 | John et al. | 399/317 |
| 4,843,429 | 6/1989 | Avritt et al. | 399/317 |
| 5,166,736 | 11/1992 | Ogawa et al. . | |
| 5,276,494 | 1/1994 | Rumpel | 399/388 |
| 5,481,352 | 1/1996 | Yamamoto et al. | 399/384 |
| 5,546,178 | 8/1996 | Manzer et al. | 399/384 |
| 5,774,777 | 6/1998 | Ohtsuka et al. | 399/384 |

FOREIGN PATENT DOCUMENTS

| | | |
|---|---|---|
| 0 432 295 A1 | 12/1989 | European Pat. Off. . |
| 57-093375 | 6/1982 | Japan . |

OTHER PUBLICATIONS

Patent Abstracts of Japan—JP57141346—Jan. 9, 1982—Shikato Masanobu—Change–Absorbing Mechanism In Continuous Paper Conveying Device.

*Primary Examiner*—Robert Beatty
*Attorney, Agent, or Firm*—Hill & Simpson

[57] ABSTRACT

An electrographic printer has an intermediate medium for simultaneously printing a first web section of an endless medium and a second web section arranged next to and at a distance from the first web section. Both web sections are drawn along a path past the intermediate medium by a transport system. During the printing process, a tensioning device biases the first and second web sections against the intermediate medium. A web-tensioning unit located downstream relative to the direction of transport of the transport device, applies a traction force to the web sections in the direction of travel. In addition, a first compensation device and a second compensation device separated from the first compensation device are provided between the transport device and tensioning device. The compensation devices bias the first or second web sections as appropriate, against the direction of transport during the printing process.

18 Claims, 7 Drawing Sheets

FIG 8
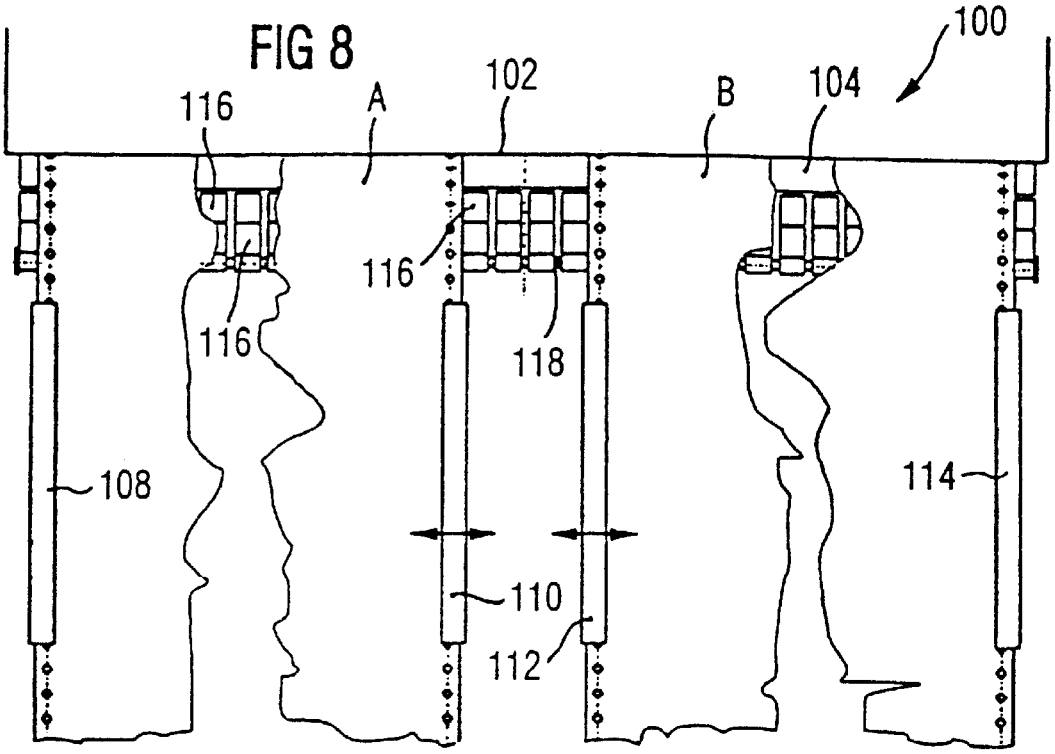
FIG 9A
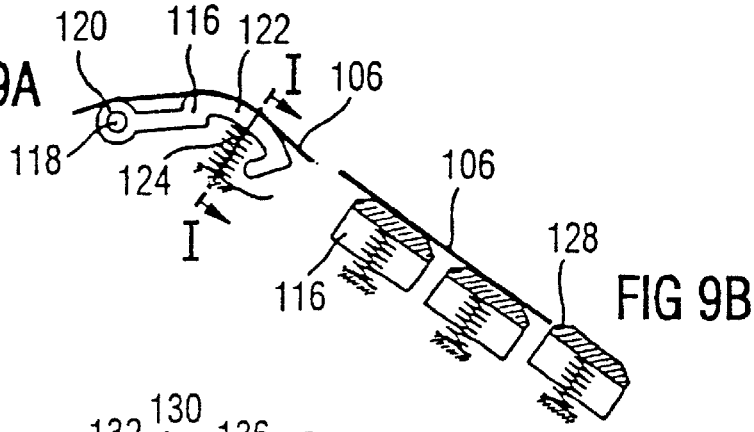
FIG 9B
FIG 10A
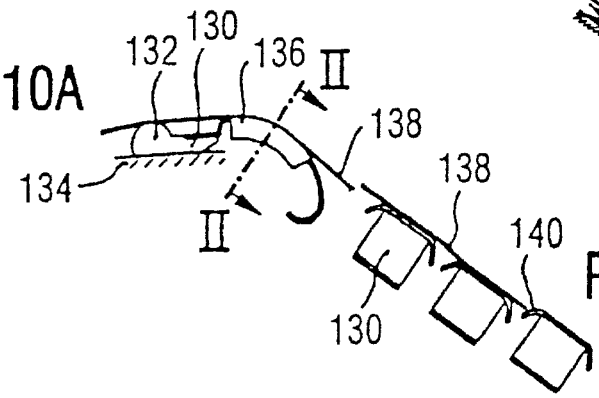
FIG 10B

ELECTROGRAPHIC PRINTER WITH COMPENSATION DEVICES

BACKGROUND OF THE INVENTION

The invention is directed to an electrographic printer comprising an intermediate image carrier for the simultaneous printing of a first web section of an endless carrier material and of a second web section arranged next to the first web section at a distance therefrom. A transport device conducts the web sections along a transport path past the intermediate image carrier. At least one tension device pre-stresses the first web section and the second web section against the intermediate image carrier during the printing process. At least one web tenser is arranged following the transport device as viewed in the transport direction and which gives the web sections a tensile stress in the transport direction during the printing process. A compensation device is arranged between the transport device and the tension device that pre-stresses the first web section or the first and second web sections opposite the transport direction during the printing process.

The invention is concerned with an improvement of an electrographic printer unit for printing band-shaped recording media of different band width according to WO 94/27193. The printer unit disclosed therein has an electrographically working intermediate image carrier, for example a photoconductor drum, a usable width of which corresponds to twice the width format of a standard form according to DIN A4 or of a letter size format. The further units, such as the fixing station, the developer station, the cleaning station, etc., are likewise designed for this usable width.

Various operating modes are possible with this known printer unit. In what is referred to as the simplex mode, thus a recording medium having up to twice the width of a sheet in the DIN A4 format or in the letter size format can be printed in a traditional way. In a parallel simplex mode, two narrow recording media arranged side-by-side, for example with a width according to DIN A4, can be conducted through the printer unit and printed in juxtaposed position.

In a further operating mode, the single-color duplex mode, the web of the recording medium is turned over upon transport through the printer unit. During the first printing event, a first web section of the web is conducted past with the front side at the transfer printing location and is subsequently supplied to the fixing station in which the toner image is joined in smear-proof fashion to the continuous carrier material under the influence of heat and pressure. After the fixing, the web is laterally offset, turned over and resupplied to the transfer printing station in the form of a second web section and is printed on the back side. In this way, it is possible to simultaneously print the first and second web section at the same transfer printing location. A two-color duplex mode is also possible by employing differently colored ink particles in different developer units of the printer unit.

In another operating mode, the two-color simplex mode, the web is offset parallel by at least one web width upon transport in the printer unit, and the offset web sections are conducted past the transfer printing location in common in juxtaposed position. During the first pass of the web at the transfer printing location, image and text elements are printed with a first color and are subsequently fixed; image and text elements are printed with the second color during the second pass of the web with offset.

The printer unit disclosed by WO 94/27193 works according to the principle of electrophotography, whereby a photoconductor on which a latent charge image corresponding to the print format to be printed is applied with the assistance of a light source, for example a laser of an LED line, is employed as a photoconductor. Ink particles of a desired color are transferred onto the photoconductor within a developer station arranged close to the photoconductor and the charge image is inked with toner particles. The developer station is followed by the print unit in which a corona device arranged at a distance from the photoconductor transfers the toner image onto the continuous carrier material with an electrical field, the continuous carrier material being passed through between photoconductor and corona device and being subsequently supplied to the fixing station in which the toner image is joined in smear-proof fashion to the continuous carrier material by heat and pressure. During the transfer of the toner image, the air between the corona device and the continuous carrier material is ionized by high field strengths, as a result of which charge carriers are generated on that side of the continuous carrier material facing away from the photoconductor. An electrostatic force field between continuous carrier material and photoconductor arises as a result thereof, this effecting, first, an adhesion of the continuous carrier material to the surface of the photoconductor and, second, a transfer of the toner image located on the photoconductor onto the continuous carrier material. Since the speed with which the surface of the photoconductor moves is slightly higher than the speed with which the continuous carrier material is conducted past the photoconductor, the continuous carrier material adhering to the surface of the photoconductor due to the force of attraction is entrained and does not separate from the surface of the photoconductor until it is outside the transfer printing station. This undefined release of the continuous carrier material from the surface of the photoconductor occurs irregularly, as a result of which smeared print formats and positional errors of the print format that deteriorate the quality of the print format arise.

For this reason, the known printer provides a compensation unit between the transport device and the tension device, this compensation unit extending over approximately the entire width of the photoconductor, pressing uniformly against that side of the first and/or second web section facing away from the photoconductor and pre-stressing the first and/or second web section with equal force opposite the transport direction, as a result of which a counter-force opposing the force of attraction is produced that leads to a defined release of the web section or, sections from the surface of the photoconductor in the region of the transfer printing location.

During the duplex mode and the two-color simplex mode, a shrinkage occurs during the fixing process of the first web section, particularly due to the influence of heat, i.e. a shortening occurs of the continuous carrier material that is resupplied to the transfer printing location as the second web section. Due to the shortening of the continuous carrier material, the compensation device is moved away from the photoconductor due to the shortened second web section that has already run through the fixing station. As a result thereof, the unshortened first web section is no longer pre-stressed by the compensation device, so that it separates from the surface of the photoconductor in undefined fashion outside the transfer printing location, which results in smeared print formats and positional errors of the print format that deteriorate the quality of the print image.

SUMMARY OF THE INVENTION

An object of the invention is to offer an electrographic printer an intermediate image carrier of which transfers toner images onto the continuous carrier material with high quality.

According to the invention, an electrographic printer, comprises an intermediate image carrier for the simultaneous printing of a first web section of an endless carrier material and of a second web section arranged next to the first web section at a distance therefrom. A transport device conducts the web sections along a transport path past the intermediate image carrier. At least one tension device pre-stresses the first web section and the second web section against the intermediate image carrier during the printing process. At least one web tenser is arranged following the transport device as viewed in a transport direction that gives the web sections a tensile stress in the transport direction during the printing process. A compensation device is arranged between the transport device and the tension device that pre-stresses the first web section opposite the transport direction during the printing process. A second compensation device separate from the first compensation device pre-stresses the second web section opposite the transport direction during the printing process.

Advantageous developments of the invention derive from the subclaims.

By employing a second compensation device separated from the first compensation device, it is possible to pre-stress the two web sections opposite the transport direction independently of one another during the printing process. It is assured in this way that the web of continuous carrier material has a uniform pre-stressing of the web section by the compensation devices in every operating mode of the printer, i.e. particularly during the duplex mode and the two-color simplex mode, despite tolerance-conditioned length differences between first and second web sections or length differences between first and second web sections caused by the fixing process. As a result, a defined release of the web section or web sections from the surface of the photoconductor is achieved in the region of the transfer printing location and a transfer of the toner image onto the continuous carrier material with uniformly high quality is enabled.

As viewed in the transport direction, the second compensation device is preferably located in the same plane as the first compensation device, whereby both compensation devices have the same spacing from the photoconductor. This structure assures that, particularly during simplex mode, one web that is wider than one of the two compensation devices is uniformly pre-stressed by both compensation devices. At the same time, the employment of identical component parts is possible for the first and second compensation device, the manufacturing and assembly expense being reduced as a result thereof.

It is especially advantageous when the first and second compensation device are rigidly connected to one another when a single web section is printed a width of which is greater than half the overall width of the transport path. Due to the rigid connection of the two compensation devices to one another, a uniform and identically directed motion of the two compensation devices is assured and a non-uniform pre-stressing of the web section is prevented. For example, the two compensation devices can be firmly connected to one another by a screwed connection. Another possibility is the employment of a pin displaceably accepted in one of the compensation devices that can be accepted in an opening provided in the other compensation device. As a result of this, the two compensation devices are rigidly connected to one another. Further, the employment of a mechanical coupling arranged between the two compensation devices that couples the two compensation devices to one another is possible. The drive of this coupling mechanism can occur both automatically by the controller of the printer as well as manually by the operator.

For example, a compensation rocker extending transversely relative to the transport direction with its longitudinal direction and pivotable around an axis proceeding in the longitudinal direction that resiliently pre-stresses the respective web section is employed as the compensation device. Mechanical spring elements such as compression springs, Belleville spring washers, or the like are suitable for resiliently pre-stressing the compensation devices. Further, it is possible to employ pneumatic or hydraulic damping devices such as, for example, small hydraulic or pneumatic shock absorbers a damping rate of which can be adapted to the respectively employed continuous carrier material.

In another embodiment, each compensation device has a plurality of compensation elements arranged spaced next to one another pivotably seated around an axis proceeding transverse to the transport path that resiliently press against the respective web section. By employing a plurality of compensation elements, only those compensation elements that lie against the web section pre-stress the web section, so that a narrow web section is pre-stressed by only a few compensation elements compared to a wide web section, and the pre-stressing force acting on the narrow web section is correspondingly lower. In this embodiment, too, the compensation elements are resiliently pre-stressed by mechanical spring elements such as compression springs, Belleville spring washers, or the like, or with the assistance of hydraulic or pneumatic damping devices. In a development of this embodiment, each compensation element is resiliently pre-stressed with a leaf spring one end of which is stationarily clamped. At its other end, the leaf spring has a plurality of spring tongues that lie against the respective compensation element during the printing process, whereby at least one of the spring tongues can be moved away from the compensation element with an actuation unit. In this way, the pre-stress force acting on the respective compensation element is reduced, for example given an interruption of the printing process. It is thereby especially advantageous to design the leaf spring long in order to obtain a flat characteristic, so that the spring power changes only slightly in the range of action of the compensation element. Three springs are preferably employed, whereby the middle spring tongue is designed stronger and is adjusted by the actuation unit.

In another embodiment, each compensation device has a plurality of compensation elements arranged spaced side-by-side in one plane, whereby each compensation element is designed as a leaf spring having a rocker-shaped crossection. Additional spring elements can be foregone by employing these prefabricated leaf springs, the expense in the assembly dropping as a result thereof.

The tension unit of the electrographic printer has at least one deflection rail extending transverse to the transport direction that is arranged preceding the intermediate image carrier as seen in the transport direction, at least one pivotably seated, lower transfer printing rocker arranged between the deflection rail and the intermediate image carrier, and at least one pivotably seated, upper transfer printing rocker arranged between the intermediate image carrier and the compensation devices. In the first operating mode of the printer wherein both web sections are printed, the two transfer printing rockers pre-stress the web sections against the intermediate image carrier, whereas they hold the web sections spaced from the intermediate image carrier in the second operating mode of the printer wherein the web sections are not printed. The employment of the two transfer printing rockers makes it possible to uniformly pre-stress the web sections both in the first as well as in the second operating mode.

In a preferred embodiment, the first and second compensation devices pre-stress the first or, respectively, second web section opposite the transport direction in the first operating mode and reduce the pre-stress at the respective web section in the second operating mode. Since the continuous carrier material does not lie against the intermediate image carrier in the second operating mode and, consequently, no attractive forces act on the first respective second web section, it is advantageous to reduce the pre-stresses caused by the compensation devices that oppose these attractive forces in order to prevent a non-uniform loading of the web sections and to simultaneously assure a malfunction-free transport by the transport unit.

The tension device and the compensation device and/or the web tenser are preferably coupled to one another by a setting mechanism that simultaneously places the devices into the first or, respectively, second operating mode.

The invention is explained in greater detail below on the basis of the drawings.

BRIEF DESCRIPTION OF THE DRAWINGS

FIG. 8 is a plan view of a second embodiment of a printer unit, comprising a plurality of compensation elements;

FIG. 9A is an enlarged side view of a compensation element according to FIG. 8;

FIG. 9B is a partially cut back view of the compensation element according to FIG. 9A, cut along the section line I—I;

FIG. 10A is an enlarged side view of a third embodiment of a printer unit comprising a plurality of spring compensation elements;

FIG. 10B is a partially cut back view of the spring compensation element according to FIG. 10A, cut along the section line II—II;

DESCRIPTION OF THE PREFERRED EMBODIMENTS

Figure 1:
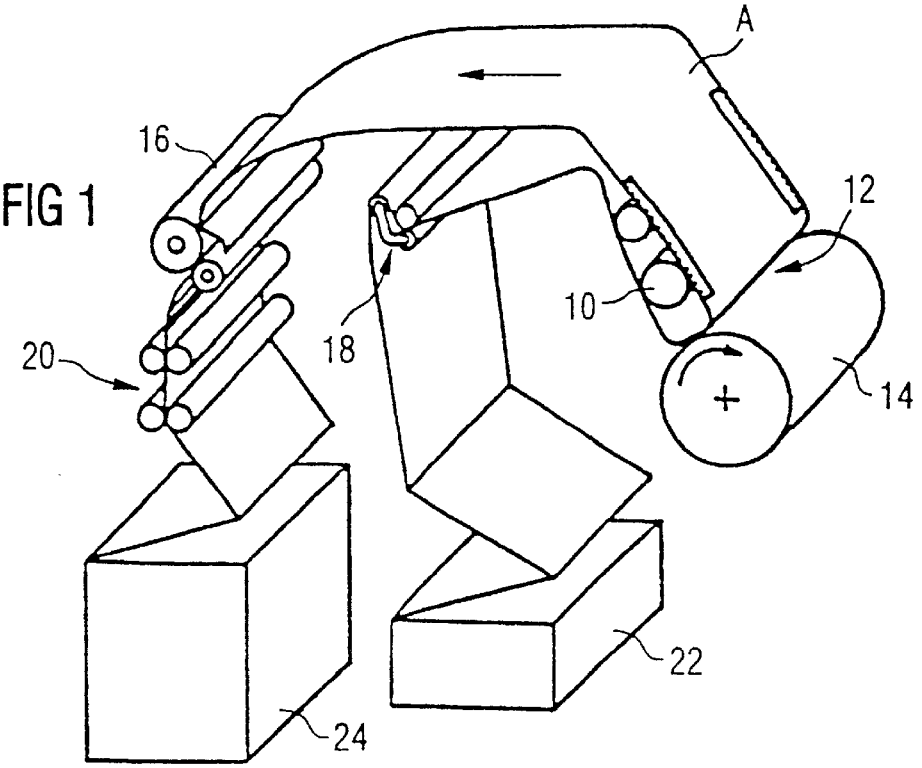
FIG. 1 is a schematic illustration of a printer that works in the simplex mode.

Details of the invention are described below upon employment of a high-performance printer that works in various operating modes shown in FIGS. 1 through 4. The printer has a transport device 10 that, arranged close to a printer unit 12, conveys continuous carrier material through the printer unit 12 in which the charge image applied on a photoconductor drum 14 and inked with toner is transferred onto the carrier material with a corona device (not shown). Subsequently, the carrier material is supplied to a fixing station 16 in which the still smearable toner image on the carrier material is joined smear-proof with the carrier material with the assistance of pressure and temperature. As viewed in the transport direction, a first deflection unit 18 is arranged preceding the printer unit 12, this conducting the carrier material to the printer unit 12 and, according to the selected operating mode, that can turn the carrier material over (see FIG. 3) or merely laterally offset it (see FIG. 4). A second deflection unit 20 is arranged following the fixing station 16 as viewed in the transport direction. This second deflection unit 20 stacks the printed carrier material and, likewise dependent on the selected operating mode, can also supply the material to the first deflection unit 18, as shall be explained later.

FIG. 1 shows the printer in a first operating mode, the simplex mode, whereby a first web section A of the carrier material from a stack 22 is supplied to the printer unit 12 by the first deflection unit 18. After printing, the transport device 10 transports the web section A in the direction of the fixing station 16 in which the toner image is firmly joined to the carrier material. Subsequently, the second deflection unit 20 stacks the web section A on a second stack 24.

Figure 2:
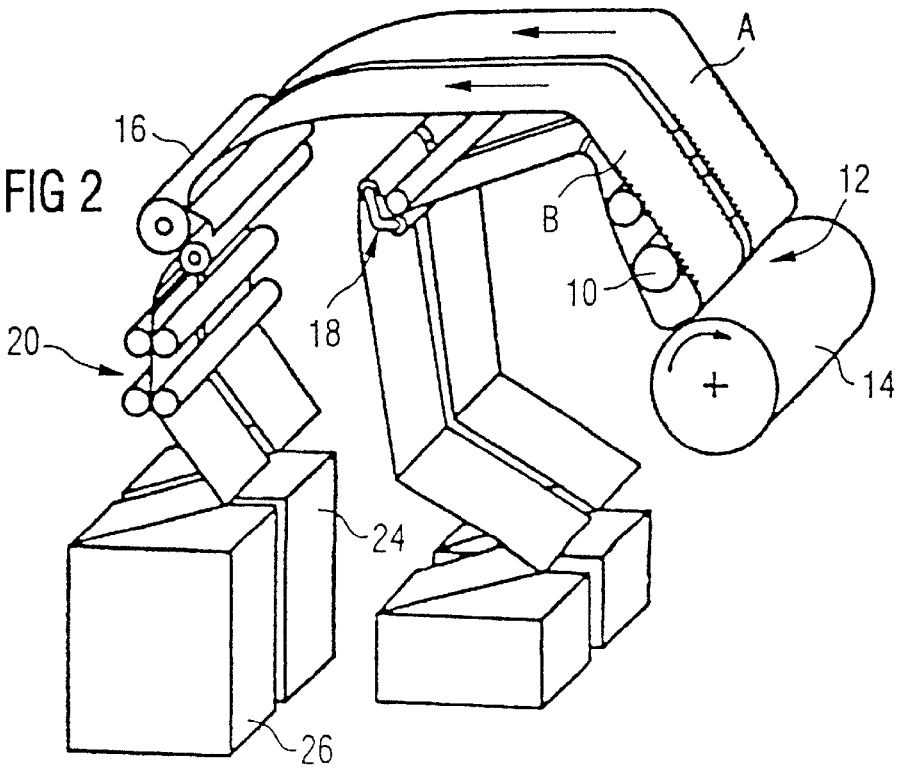
FIG. 2 is a schematic illustration of the printer according to FIG. 1 that works in the parallel simplex mode.

FIG. 2 shows the printer in a second operating mode, the parallel simplex mode, in which a first web section A and a second web section B arranged next to it are simultaneously conducted through the printer unit 12 and the fixing station 16 and are subsequently stacked onto two stacks 24 and 26 by the second deflection unit 20.

Figure 3:
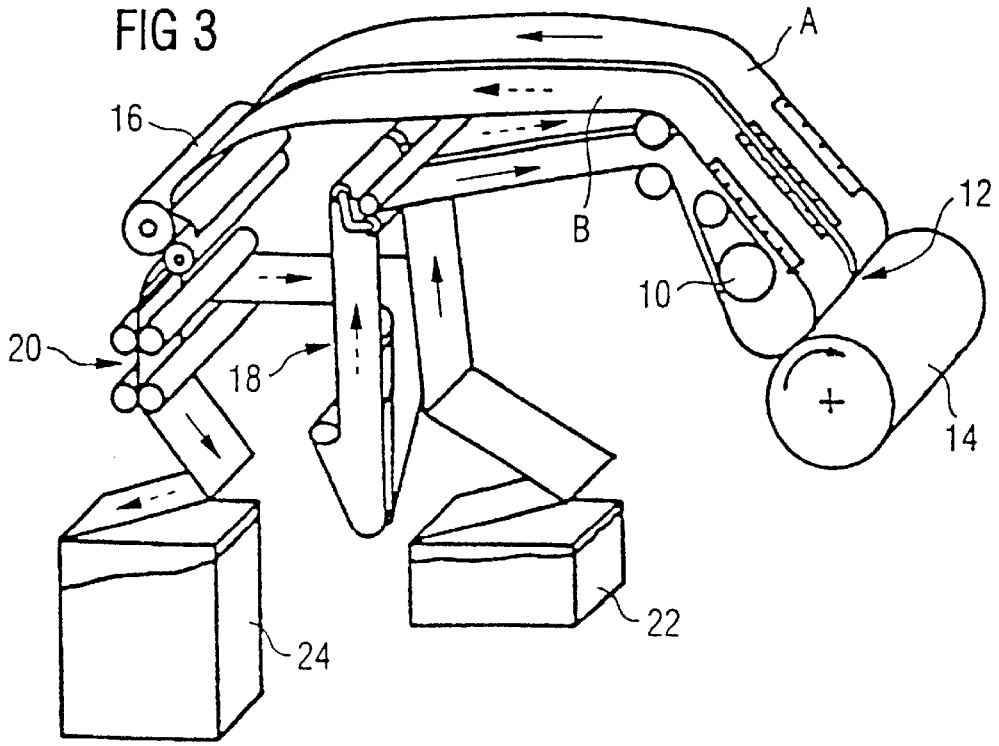
FIG. 3 is a schematic illustration of a printer according to FIG. 1 that works in the duplex mode.

FIG. 3 shows a third operating mode of the printer, the duplex mode, whereby the continuous carrier material is printed on the front and back side. For that purpose, the carrier material is supplied to the printer unit 12 in a first web section A proceeding from a first stack 22. After the printing, the first web section A is conducted through the fixing station 16 and is subsequently supplied to the first deflection unit 18 by the second deflection unit 20. The first deflection unit 18 turns the carrier material over and laterally offsets it by at least one web width, so that the back side of the carrier material can now be supplied to the printer unit 12. After being turned over, the carrier material is referred to as second web section B. When the second web section B has passed through the printer unit 12 and the carrier material carries a second print image on its back side, it is supplied to the fixing station 16 that connects the print image on the back side of the continuous carrier material smear-proof to the continuous carrier material. At the conclusion of the fixing process, the continuous carrier material is stacked up in the form of a stack 24.

Figure 4:
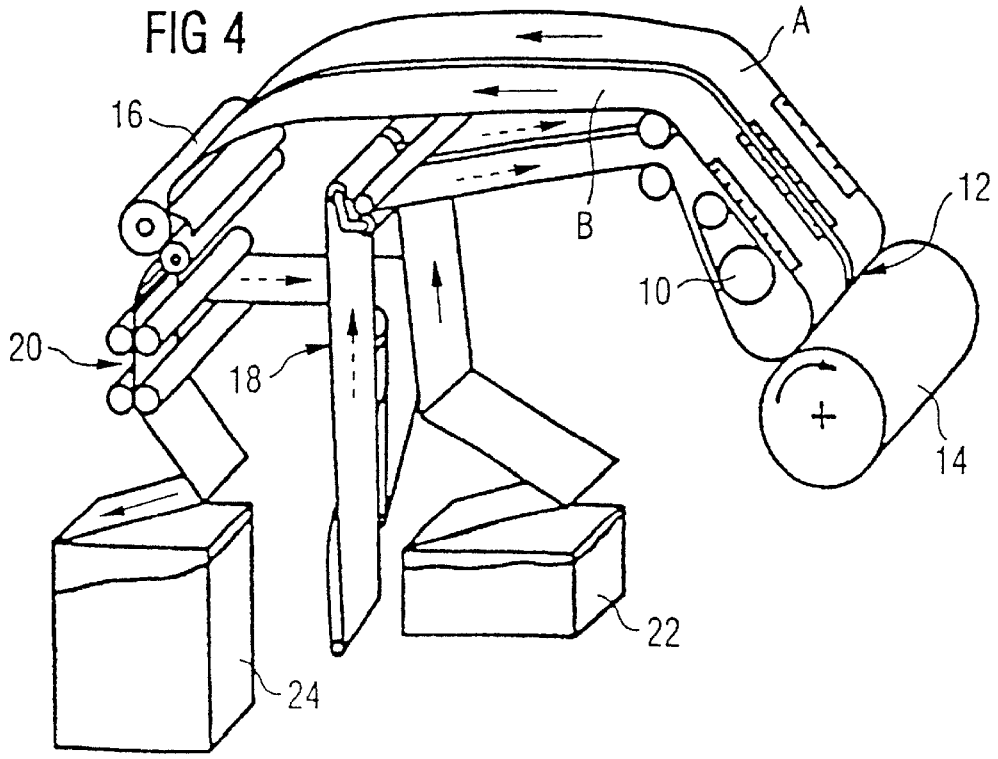
FIG. 4 is a schematic illustration of the printer according to FIG. 1 that works in the two-color simplex mode.

FIG. 4 shows a fourth operating mode, the two-color simplex mode, whereby the front side of the continuous carrier material is first printed in a first color and is then printed in a second color in a second printing pass following thereupon. For this purpose, the carrier material is supplied to the printer unit 12 as first web section A with the assistance of the first deflection unit 18. After the carrier material has been printed by the printer unit 12, the transport device 10 transports the carrier material into the fixing station 16 in order to firmly join the toner image with the carrier material. After the conclusion of the fixing process, the carrier material is supplied again by the second deflection unit 20 to the first deflection unit 18, which conducts the carrier material to the printer unit 12 laterally offset by at least one web width. After the offset of the carrier material by the first deflection unit 18, the section of the carrier unit is referred to as second web section B. This web section B passes through the printer unit 12 in which the second print image is transferred onto the web section B. After the print image has been accepted by the carrier material, the transport device 10 conveys the second web section B to the fixing station 16. In the fixing station 16, the second print image is fixed on the second web section B, which is subsequently stacked on a second stack 24 by the second deflection unit 20.

Various embodiments of a printer unit that can be employed in the above-described printer are described in detail below.

Figure 5:
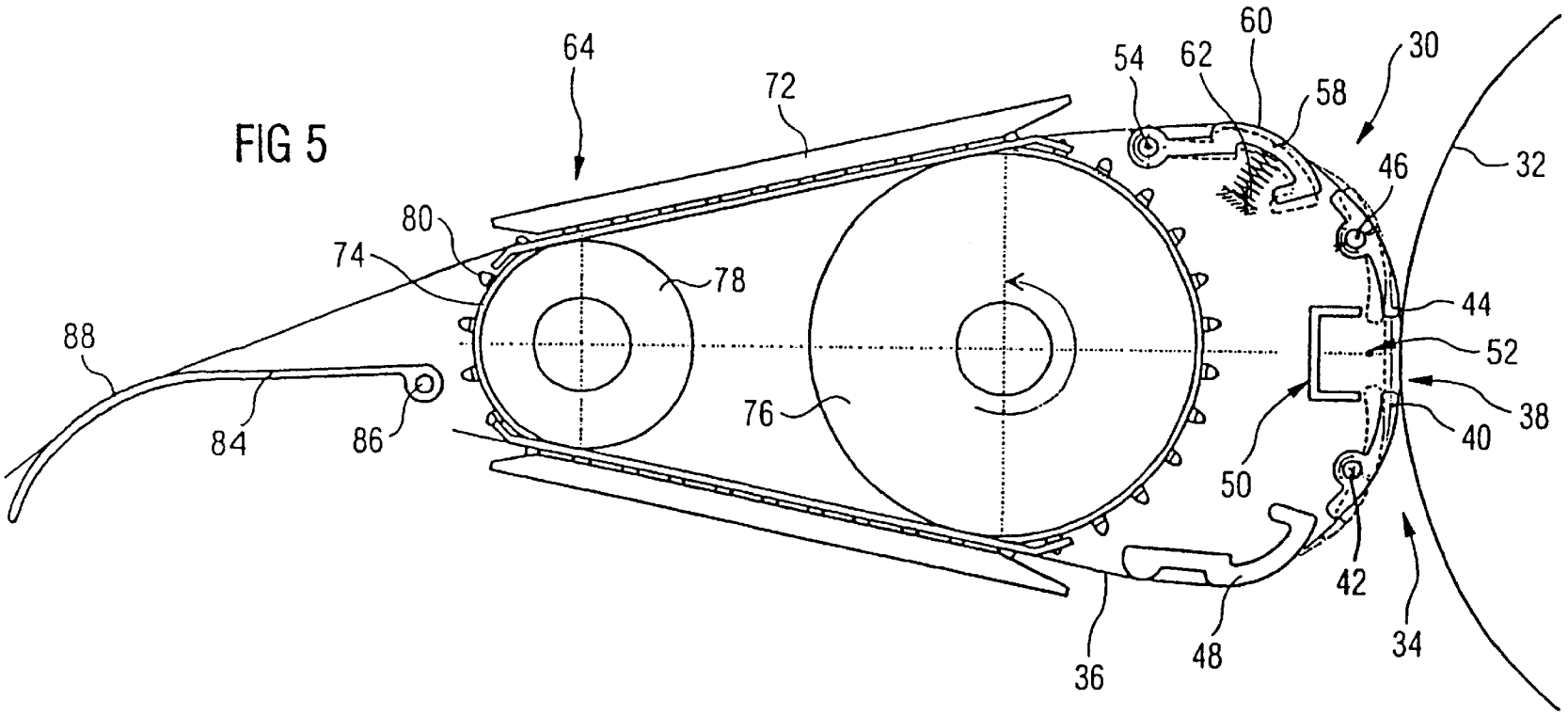
FIG. 5 is a side view of an exemplary embodiment of a printer unit.

FIG. 5 shows a side view of a first embodiment of a printer unit 30 having a photoconductor drum 32 and a tension device 34 that pre-stresses a web 36 of continuous carrier material in a first operating condition, i.e. during the printing process, against the photoconductor drum 32 and conducts it past a transfer printing location 38. In a second operating condition, the tension device 34 holds the web 36 at a distance from the photoconductor drum 32 (shown with broken lines). The tension device 34 has a lower transfer printing rocker 40 arranged under the transfer printing location 38 that is seated pivotable around a lower axis 42 in its longitudinal direction proceeding transverse to the transport direction. An identically designed upper transfer printing rocker 44 is arranged above the transfer printing location, this being seated pivotable around an upper axis 46 in its longitudinal direction proceeding transverse to the transport direction. A further component part of the tension device 34 is a deflection rail 48 extending transverse to the transport direction and arranged preceding the lower transfer printing rocker 40 as viewed in the transport direction, this deflection rail 48 conducting the web 36 to the lower transfer printing rocker 40 in a predetermined attitude.

A corona device 50 having a corona wire 52 stretched parallel to the longitudinal axis of the photoconductor drum 32 at a constant distance therefrom is also provided in the region of the transfer printing location 38, namely between the lower transfer printing rocker 40 and the upper transfer printing rocker 44 at that side of the web 36 facing away from the photoconductor drum 32.

As seen in the transport direction, a rotational axis 54 on which two identically fashioned compensation rockers 56 and 58 (only the second compensation rocker 58 thereof can be seen in FIG. 5) extending transverse to the transport direction are pivotably seated is arranged following the tension device 34 parallel to the longitudinal axis of the photoconductor drum 32. Each of the compensation rockers 56 and 58 has a guide section 60 that lies against the underside of the web 36 and carries a compression spring 62 at its side facing away from the web 36 that is supported at the frame of the printer and pre-stresses the first compensation rocker 56 or, respectively, the second compensation rocker 58 resiliently against the web 36 in the first operating mode.

The web 36 is conducted past the printer unit 30 with a transport device 64. The transport device 64 has a total of four crawler units 66, 68, 70 and 72 of which, however, only the fourth crawler unit 72 can be seen in FIG. 5, the structure thereof being identical to the structure of the crawler units 66, 68 and 70.

The crawler unit 72 has a conveyor belt 74 aligned in the transport direction of the web 36 that is pulled on a drive wheel 76 of a larger diameter and is kept under pre-stress with a tension wheel 78 of a smaller diameter that is arranged at a distance from the drive wheel 46 aligned therewith. A plurality of transport pins 80 arranged equally spaced following one another in the transport direction are secured on the radially outward facing surface of the conveyor belt 74. The transport pins 80 engage in transport holes 82 that are designed with constant spacing, likewise seen in the transport direction, at the left and right edge of the web 36.

A web tenser 84 is shown in FIG. 5 following the transport device 64 as seen in the transport direction, this web tenser 84 extending in longitudinal direction transverse to the transport direction and being seated pivotable around an axis 86 arranged parallel to the longitudinal axis of the photoconductor drum 32. The web tenser 84 is designed as a rocker that has its tapering end 88 lying against the web 36 under pre-stress in the first operating mode, and that is pivoted away from the web 36 with an actuator (not shown) in the second operating mode.

Figure 6:
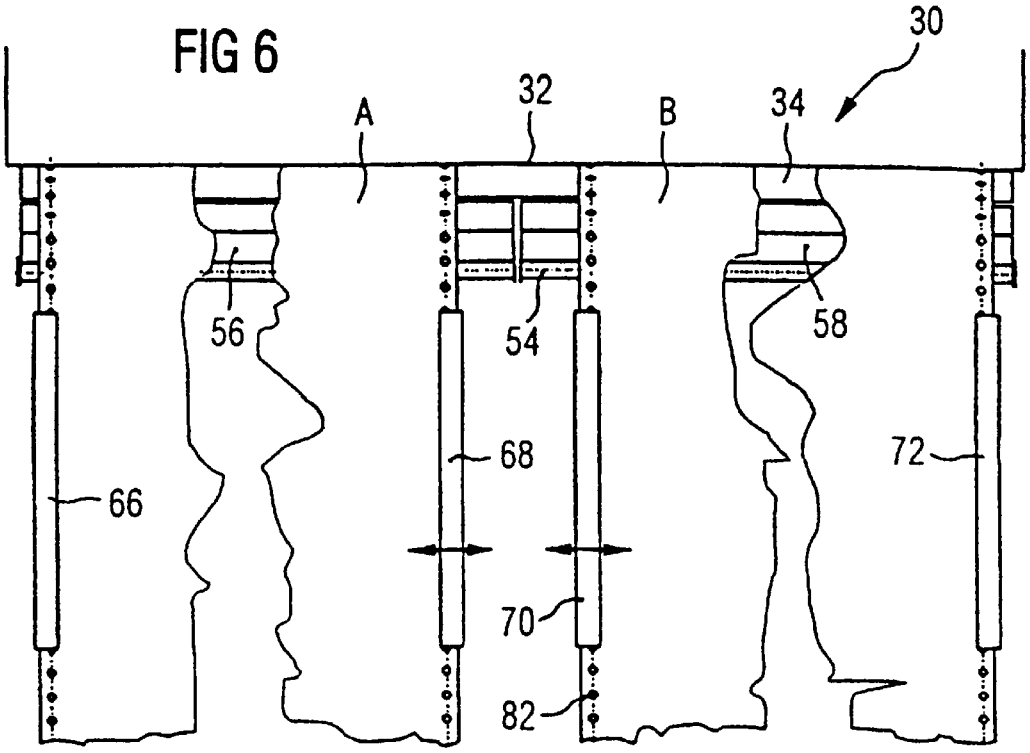
FIG. 6 is a plan view of the printer unit according to FIG. 5 when printing two web sections arranged spaced side-by-side.

FIG. 6 shows a plan view onto the printer unit 30 during the printing of two web sections A and B of the web 36 of continuous carrier material. To this purpose, the first web section A, using the two crawler units 66 and 68, and the second web section B, using the two crawler units 70 and 72, is conducted past the transfer printing location 38, whereby the tension device 34 pre-stresses the two web sections A and B against the surface of the photoconductor drum 32. After the two web sections A and B have passed the transfer printing location 38, they are conducted via the first compensation rocker 56 or, respectively, second compensation rocker 58 respectively allocated to them that pre-stress the two web sections A and B independently of one another.

Figure 7:
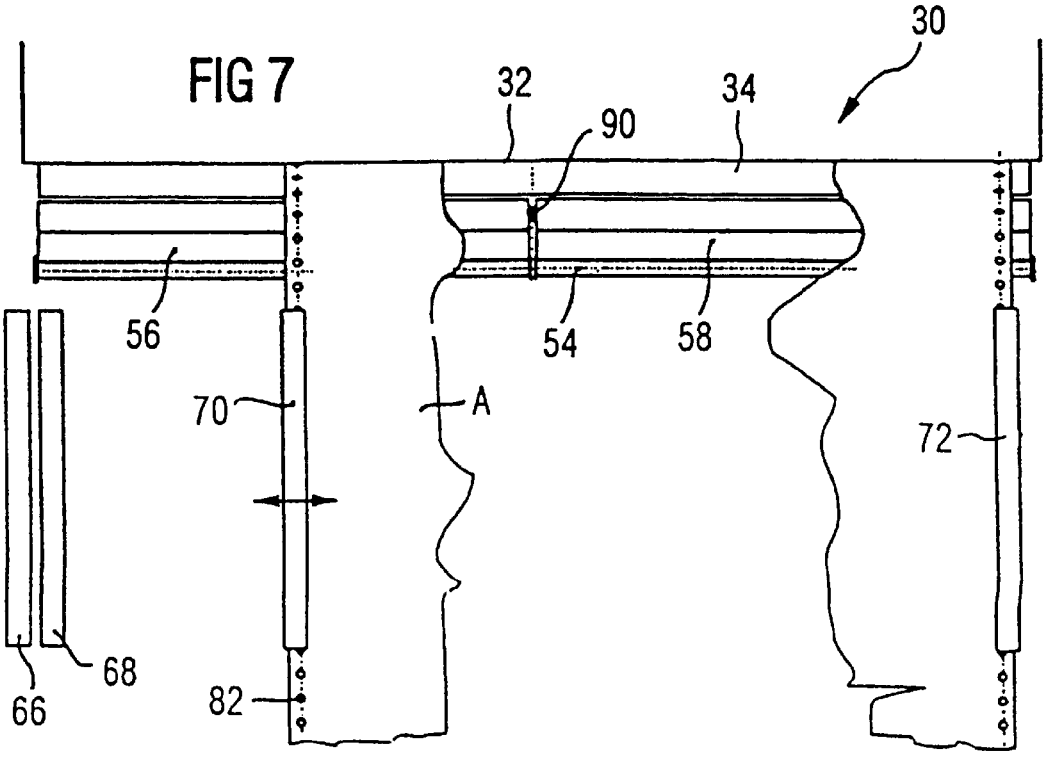
FIG. 7 is a plan view of the printer unit according to FIG. 5 when printing a first web section extending approximately over the entire width of a photoconductor.

FIG. 7 shows a plan view of the printer unit 30 during the printing of a single, particularly wide web section A of the web 36 of continuous carrier material that lies both on the first compensation rocker 56 as well as on the second compensation rocker 58. The transport occurs via the third and fourth crawler unit 70 and 72 that are set corresponding to the width of the web section A, whereas the first and second crawler unit 66 or, respectively, 68 are moved laterally out of the transport path, shown at the left in FIG. 8. In order to achieve a uniform pre-stress of the web section A over the entire width, the two compensation rockers 56 and 58 are firmly connected to one another with a pin 90 at their end faces facing toward one another.

FIG. 8 shows a second embodiment of a printer unit 100 with a photoconductor drum 102 and a tension device 104 during the printing of two web sections A and B of a web 106 of continuous carrier material. The two web sections A and B are respectively conducted past the photoconductor drum by a first and second crawler unit 108 and 110 or, respectively, a third and fourth crawler unit 112 and 114. The length compensation of the web sections A and B occurs via a plurality of compensation elements 116 that are seated pivotable around a rotational axis 118 arranged parallel to the longitudinal axis of the photoconductor drum 102 and against which the underside of the first web section A or, respectively, second web section B facing away from the photoconductor drum 102 lie under pre-stress.

FIG. 9A shows an enlarged side view of the compensation elements 116 that respectively have a bearing section 120 seated at the rotational axis 118 and have a guide section 122 lying against the underside of the web 106. A small compression spring 124 is secured to each compensation element 116 at that side of the guide section 122 facing away from the web 106, the other end of said compression spring 124 being supported at the frame 126 of the printer and thus resiliently pre-stressing the compensation element against the web 106. FIG. 9B shows a partially cut back view of the compensation elements 116 along the section line I—I of FIG. 9A. As can be seen from FIG. 9B, the compensation elements 116 are respectively designed bevelled at their lateral edges 128 respectively aligned in the transport direction, as a result whereof damage to the side edges of the web 106 is prevented.

FIG. 10A shows a third embodiment of a printer unit wherein spring compensation elements 130 are employed. These spring compensation elements 130 have a fastening section 132 with which they are secured to the frame 134 of the printer and a guide section 136 on whose upper side a web 138 of the continuous carrier material is conducted. FIG. 10B shows a sectional back view along the section line II—II of FIG. 10A from which it can be seen that the spring compensation elements 130 are bevelled at their lateral edges 140 proceeding in the transport direction in order to prevent damage to the edges of the web 138.

By employing many small compensation elements—as described in the second and third exemplary embodiment—that respectively lie against the underside of the web of carrier material under pre-stress with only a slight force, it is possible to also conduct especially narrow web sections through the printer, since the pre-stress force, which is defined only by the compensation elements actually in use, is very slight and an excessively great pre-stressing of the endless carrier material is avoided.

Figure 11:
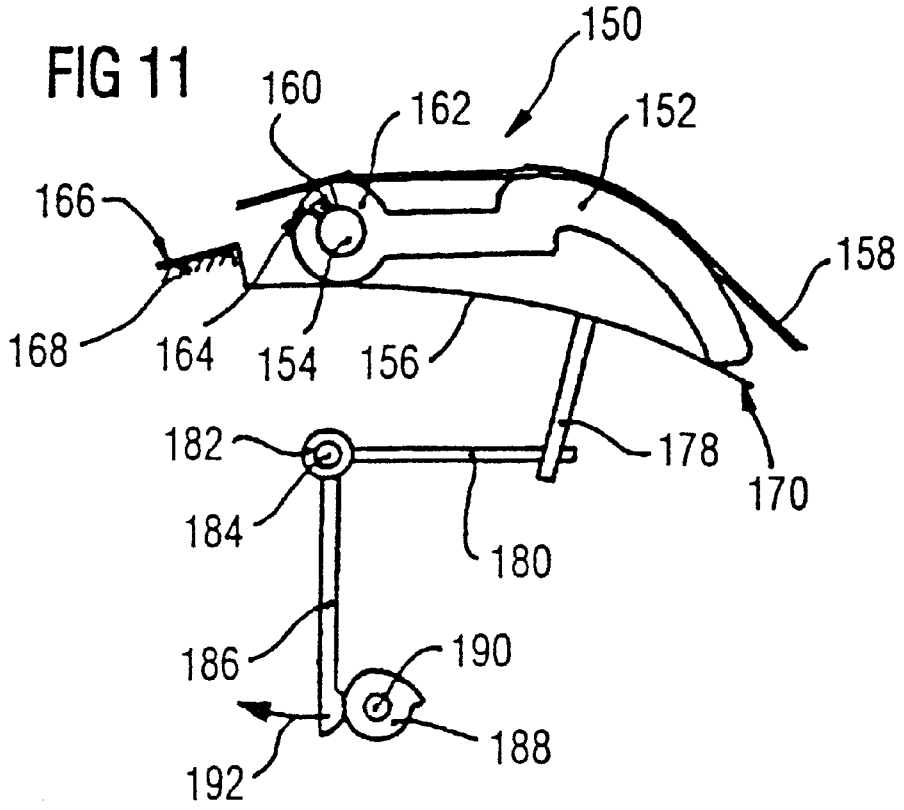
FIG. 11 is a side view of a fourth embodiment of a printer unit with compensation elements that are pre-stressed with leaf springs.

FIG. 11 shows a side view of a fourth embodiment of a printer unit 150, whereby a plurality of compensation elements 152 pivotably seated on a common rotational axis 154 are respectively resiliently pre-stressed against a web 158 of carrier material by a leaf spring 156. Further, a peg 160 that projects radially outward from the rotational axis and projects into a recess 164 fashioned at the bearing section 162 of each compensation element is provided for each compensation element 152. The swivel motion of the compensation element 154 is limited by the peg 160 in order, given a narrow web 158, to prevent one of its lateral edges from threading in at a compensation element 152. By swivelling the rotational axis 154, the pegs 160 entrain the compensation elements 152 and move them away from the web 158 simultaneously and in the same sense.

Figure 12:
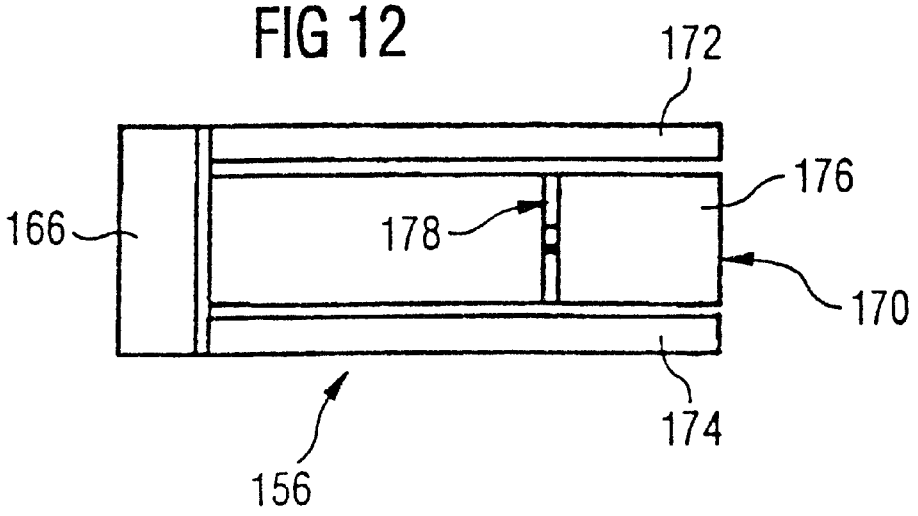
FIG. 12 is a plan view of a leaf spring that is employed in the printer unit according to FIG. 11.

The leaf spring 156 has its one end 166 secured to the frame 168 of the printer, whereas the free, other end 170 lies against the underside of the compensation element 152. As can be seen from FIG. 12, the end 170 has two narrow, laterally arranged spring tongues 172 and 174 and a middle spring tongue 176 of greater width provided between the two spring tongues 172 and 174 that, as FIG. 11 shows, has perpendicularly downwardly projecting U-shaped section 178. The free end of a first lever 180 that radially projects from a bushing rotatably seated on a shaft 184 is accepted in an acceptance opening (not shown) in this U-shaped section 178. A second lever arranged at a right angle relative to the first lever 180 and likewise radially projecting from the bushing 182 has its free end seated against a can 188 under pre-stress due to the action of a spring (not shown), this cam 188 being radially seated on a further shaft 190.

During the printing procedure, all spring tongues 172,174 and 176 lie uniformly against the compensation element 152, as a result whereof the web 158 is pre-stressed opposite the transport direction. When the pre-stress present at the web 158 is to be reduced, then the cam 188 is swivelled out of its neutral position, as a result of which the second lever 186 is moved in the direction of the arrow 192. Due to the movement of the second lever 186, the bushing 182 and the first lever 180 torsionally connected thereto are also moved, the latter bending the middle spring tongue 176 away from the compensation element with the assistance of the U-shaped section 178. As a result thereof, the spring power acting on the compensation element 152 and the pre-stress at the web 156 decreases.

Given a printer device constructed according to FIG. 3, the B-web already carries a fixed toner image given the repeated passage through the transfer printing station (printer unit 12). When a transfer printing station according to an embodiment shown in FIG. 5 is employed, the toner image that has already been fixed comes into contact with the deflection rail 48 and rubs against it. There is thus the risk that toner dust will deposit following the round deflection regions as viewed in the transport direction, this toner dust being entrained after a corresponding amount has been built up, and noticeably disturbs the print image with spots. The same is true of the deflection in the region of the deflection rail 48 of the A-web. Here, too, paper abrasion and toner dust can deposit, this then being additionally fixed onto the toner images by the fixing station.

In order to prevent the deposit of dust, it is generally beneficial to arrange deflection rollers in the paper channel of the printer device instead of deflection rails with glide surfaces. These rollers can freely co-rotate or, respectively, be additionally driven. There is thus no longer any relative motion between paper and deflection and, thus, no longer any toner accumulation due to abrasion.

Figure 13:
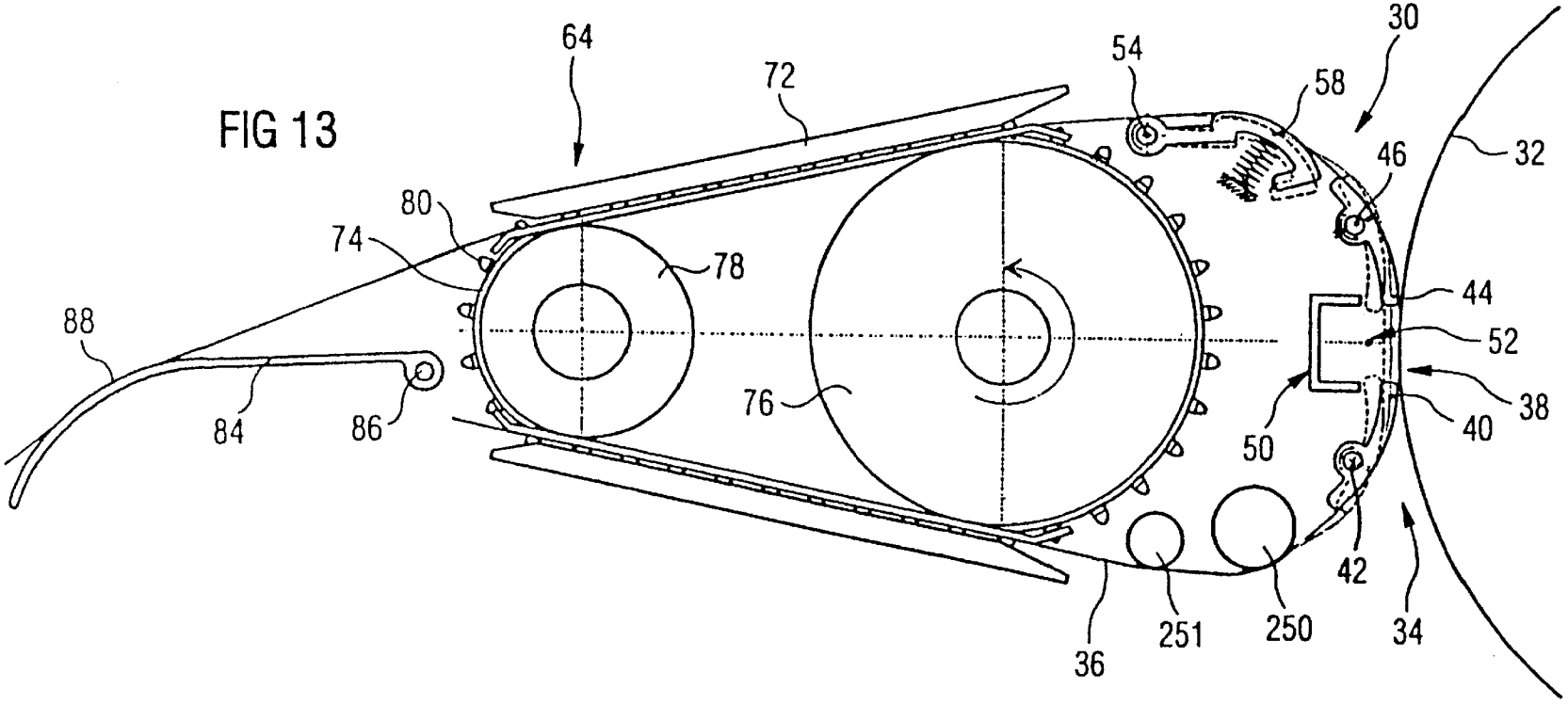
FIG. 13 is a side view of an exemplary embodiment of a printer unit with rollers as deflection elements.

In the embodiment of the transfer printing station according to FIG. 13, rollers 250 and 251 are provided instead of the rigid deflection rail of FIG. 5. These can be continuously composed of one piece or of one or more individual rollers arranged next to one another. It is also possible to arrange individual rollers on a rail. It is generally thereby important that rollers are located in the region of deflections. The deflection regions of the second compensation rocker 58 can also potentially comprise rollers. The same is also true of other deflection points in the paper channel of the printer device.

In order to prevent an electrostatic charging of the generated surfaces of the rollers 250, 251, it is beneficial to ground these or to see is to an elimination of the charge with discharge brushes, combs or the like.

Although various minor changes and modifications might be proposed by those skilled in the art, it will be understood that our wish is to include within the claims of the patent warranted hereon all such changes and modifications as reasonably come within our contribution to the art.

We claim as our invention:

1. An electrographic printer, comprising:

an intermediate image carrier for simultaneous printing of a first web section of an endless carrier material and of a second web section arranged next to the first web section at a distance therefrom;

a transport device that conducts the first and second web sections along a transport path past the intermediate image carrier;

at least one tension device that pre-stresses the first web section and the second web section against the intermediate image carrier during the printing process;

at least one web tenser arranged following the transport device as viewed in a transport direction of the web section that provides the web sections with a tensile stress in the transport direction during the printing process;

a first compensation device arranged between the transport device and the tension device that pre-stresses the first web section opposite the transport direction during the printing process; and a second compensation device arranged between the transport device and the tension device separate from the first compensation device that pre-stresses the second web section opposite the transport direction during the printing process.

2. The electrographic printer according to claim 1 wherein the second compensation device is located in a same plane as the first compensation device as viewed in the transport direction, and both compensation devices have a same spacing from the intermediate image carrier.

3. The electrographic printer according to claim 1 wherein a connecting unit is provided connecting the first and second compensation devices rigidly to one another when a single web section is printed, a width of the single web section being greater than half a total width of the transport path.

4. The electrographic printer according to claim 1 wherein each compensation device is at least a compensation rocker extending in a longitudinal direction transverse to the transport direction and pivotable around an axis proceeding in the longitudinal direction, said compensation rocker resiliently pre-stressing the respective web section.

5. The electrographic printer according to claim 1 wherein each compensation device has a plurality of compensation elements arranged spaced side-by-side, are seated pivotable around an axis preceeding transverse to the transport path, and lie resiliently against the respective web section.

6. The electrographic printer according to claim 5 wherein each compensation element is resiliently pre-stressed with a leaf spring having one end stationarily clamped; and the other end of the leaf spring has a plurality of spring tongues that lie against the respective compensation element during the printing process so that at least one of the spring tongues can be moved away from the compensation element with an actuation unit.

7. The electrographic printer according to claim 1 wherein the leaf spring has three spring tongues so that a middle spring tongue is moved by the actuation unit, and wherein the actuation unit is realized by a lever arrangement lying against a cam.

8. The electrographic printer according to claim 1 wherein each compensation device has a plurality of compensation elements arranged spaced side-by-side in one plane; and each compensation element is designed as a leaf spring having a rocker-shaped cross-section.

9. The electrographic printer according to claim 1 wherein the at least one tension device has at least one deflection rail extending transverse to the transport direction that is arranged preceding the intermediate image carrier as seen in the transport direction, at least one pivotably seated, lower transfer printing rocker arranged between a deflection rail and the intermediate image carrier, and at least one pivotably seated, upper transfer printing rocker arranged between the intermediate image carrier and the compensation devices so that in a first operating mode of the printer where both web sections are printed, the two transfer printing rockers pre-stress the web sections against the intermediate image carrier and in a second operating mode of the printer hold the web sections spaced from the intermediate image carrier when the web sections are not printed.

10. The electrographic printer according to claim 1 wherein the first and second compensation devices pre-stress the first or second web sections respectively opposite the transport direction in a first operating mode; and wherein they reduce the pre-stress at the respective web sections in a second operating mode.

11. The electrographic printer according to claim 1 wherein the at least one web tenser is a rocker that extends in a longitudinal direction transverse to the transport direction and is pivotable around an axis proceeding in the longitudinal direction, a tapering end thereof lying under pre-stress against the respective web section only in a first operating mode.

12. The electrographic printer according to claim 10 wherein a setting unit that couples the at least one tension device and the compensation devices or the at least one web tenser to one another and sets them simultaneously into a first or second operating mode.

13. The electrographic printer according to claim 1 wherein a photoconductor is provided as said intermediate image carrier.

14. The electrographic printer according to claim 1 wherein the printer comprises deflection roller, at deflection points of a recording medium that comes into contact with a toner image that has already been fixed.

15. The electrographic printer according to claim 14 wherein the tension device comprises at least one deflection roller extending transverse to the transport direction that is arranged preceding the intermediate image carrier as seen in the transport direction.

16. The electrographic printer according to claim 14 wherein a unit preventing electrostatic charges of at least a generated surface of the deflection rollers is provided.

17. An electrographic printer, comprising:

an intermediate image carrier for simultaneous printing of a first web section of an endless carrier material and of a second web section arranged next to the first web section at a spacing therefrom;

a transport device that conducts the first and second web sections along a transport path past the intermediate image carrier;

at least one tension device that pre-stresses the first web section and the second web section relative to the intermediate image carrier during the printing process;

at least one web tenser arranged following the transport device as viewed in a transport direction of the web sections that provides the web sections with a desired tensile stress during the printing process;

a first compensation device arranged following the tension device in said transport direction and before an outfeed portion of said transport device for providing a desired pre-stress of the first web section during the printing process; and a second compensation device separate from the first compensation device following the tension device in said transport direction and before said outfeed portion of said transport device for providing a desired pre-stress of said second web section during the printing process.

18. The printer according to claim 17 wherein the first compensation device and second compensation device each comprise a spring loaded rocker pivoting about a respective rotational axis and wherein said tension device comprises a first transfer printing rocker and a second transfer printing rocker lying to each side of a transfer printing location and wherein each printing rocker pivots about a respective rotational axis, and wherein said web tenser comprises a pivoting arm rotating about a respective pivoting axis.

* * * * *